US005698813A

United States Patent [19]

Ramsay et al.

[11] Patent Number: 5,698,813

[45] Date of Patent: Dec. 16, 1997

[54] VISUAL INDICATOR ASSEMBLY

[75] Inventors: Peter Ramsay, Oak Park; John Christopher Galati, Lalor; Manuel Pires De Sousa, Haberfield, all of Australia

[73] Assignee: Commonwealth of Australia, Canberra, Australia

[21] Appl. No.: 624,373

[22] PCT Filed: Oct. 6, 1994

[86] PCT No.: PCT/AU94/00608

§ 371 Date: Jul. 10, 1996

§ 102(e) Date: Jul. 10, 1996

[87] PCT Pub. No.: WO95/10019

PCT Pub. Date: Apr. 13, 1995

[30] Foreign Application Priority Data

Oct. 6, 1993 [AU] Australia ..... PM 1654

[51] Int. Cl.[6] ..... F42B 22/00

[52] U.S. Cl. ..... 102/407

[58] Field of Search ..... 102/407

[56] References Cited

U.S. PATENT DOCUMENTS

| | | | |
|---|---|---|---|
| 2,775,939 | 1/1957 | Fogal | 162/407 |
| 2,912,929 | 11/1959 | Mattingly et al. | 102/407 |
| 2,949,853 | 8/1960 | Vogt | 102/407 |
| 3,086,464 | 4/1963 | Butler | 102/407 |
| 3,709,148 | 1/1973 | Costley et al. | 102/407 |
| 4,141,295 | 2/1979 | Campbell et al. | 102/407 |

FOREIGN PATENT DOCUMENTS

| | | |
|---|---|---|
| 1024143 | 3/1966 | United Kingdom . |
| 2 264 902 A | 9/1993 | United Kingdom . |

*Primary Examiner*—Michael J. Carone
*Assistant Examiner*—Matthew J. Lattig
*Attorney, Agent, or Firm*—Merchant, Gould, Smith, Edell, Welter & Schmidt, P.A.

[57] ABSTRACT

A visual indicator assembly for use with an underwater mine system comprises a surface position marker (11) having a buoyancy device (23), the marker (11) being adapted to provide visual and/or audible indications on the surface that a mine has been "fired". The assembly further comprises a support device (13) for supporting the marker (11) underwater and a severable coupling (37) which, when severed, releases the marker (11) to float to the surface. The assembly further comprises a release means selectively operable to sever the coupling (37) and to release the marker (11) to float to the surface.

15 Claims, 4 Drawing Sheets

VISUAL INDICATOR ASSEMBLY

The present invention relates to a visual indicator assembly for use in underwater operations.

In particular the present invention relates to a visual indicator assembly for use with a Stonefish Exercise Mine ("SEM") to provide a visual indication to surface vessels that the SEM has been "detonated".

The Royal Australian Navy acquired recently a number of SEMs manufactured by Marconi Underwater Systems Limited for use in training exercises for mine detection and clearance. The SEM is a programmable magnetic/acoustic/pressure influence ground mine which can be used in depths of water to 90 meters and is deployed at sea by lowering the mine onto the water by crane and then releasing it to sink uncontrolled to the sea bed.

The SEM is capable of communicating through a ship-activated acoustic sonar link within the frequency range of 12 kHz to 16 kHz. When "fired" a firing signal generated by the SEM is recorded via an in-water receiver/recorder towed behind an attendant vessel. The mine firing signal is registered on a display in the ship's bridge to tell the commanding officer that the mine has "detonated".

The limited availability and the cost of the towed recorder precludes the fitting of this equipment to all ships which exercise with the SEM. Consequently, ships without the benefit of the in-water electronics must rely upon receiving the results of the mine data transmission messages from other ships. The delay in notifying the recipient, and other ships, that a critical mine encounter may have occurred causes a significant lack of realism and concern to participating ships and devalues the training exercise.

With the above in mind, an object of the present invention is to provide a real time visual mine firing indicator which will indicate to all ships in an exercise that a SEM has transmitted a detonation signal.

According to the present invention there is provided a visual indicator assembly for use in underwater applications comprising:

(a) a surface position marker having a buoyancy means, the marker being adapted to provide visual and/or audible indications on the surface;

(b) a support means for supporting the marker underwater;

(c) a severable coupling which, when severed, releases the marker to float to the surface; and (d) a release means selectively operable to sever the coupling and to release the marker to float to the surface.

It is preferred that the marker be adapted to provide visual indications when it floats to the surface.

It is preferred particularly that the marker be adapted to provide visual and audible indications when it floats to the surface.

It is preferred that the marker comprise visual and/or audible pyrotechnics components.

It is preferred that the marker comprises an ignition system for the visual and/or audible pyrotechnics components.

It is preferred that the release means be responsive to a "fired" signal from a Stonefish Exercise Mine.

It is preferred particularly that the "fired" signal be a sonar signal.

It is preferred that the release means comprises a means for receiving and recognizing the "fired" signal.

It is preferred that the release means comprises an ejection means for applying a tensile force between the marker and the support means to sever the coupling and to release the marker after the "fired" signal has been recognised.

It is preferred that the marker houses the ejection means.

It is preferred particularly that the marker comprises a watertight compartment and that the ejection means be located in the compartment.

It is preferred more particularly that the severable coupling couples together a forward section and a rear section of the marker.

With such an arrangement it is preferred that the ejection means be operable to apply a force against a rear end of the forward section of the marker and that the rear section of the marker be retained by the support means.

It is preferred that the ejection means be adapted simultaneously to actuate the ignition system for the visual and/or audible pyrotechnics components of the marker.

It is preferred that the visual indicator assembly further comprises a delay fuse to delay ignition of the ignition system for the visual and/or audible pyrotechnics components of the marker until the marker reaches the surface.

It is preferred that the visual indicator assembly comprises:

(a) a plurality of the markers; and (b) a plurality of the severable couplings.

It is preferred that the release means be operable to sever the couplings and to release the markers successively in a predetermined sequence.

According to the present invention there is also provided, in combination, the visual indicator assembly described above connected to a Stonefish Exercise Mine.

The present invention is described hereinafter by way of example with reference to the accompanying drawings, in which.

Figure 1:
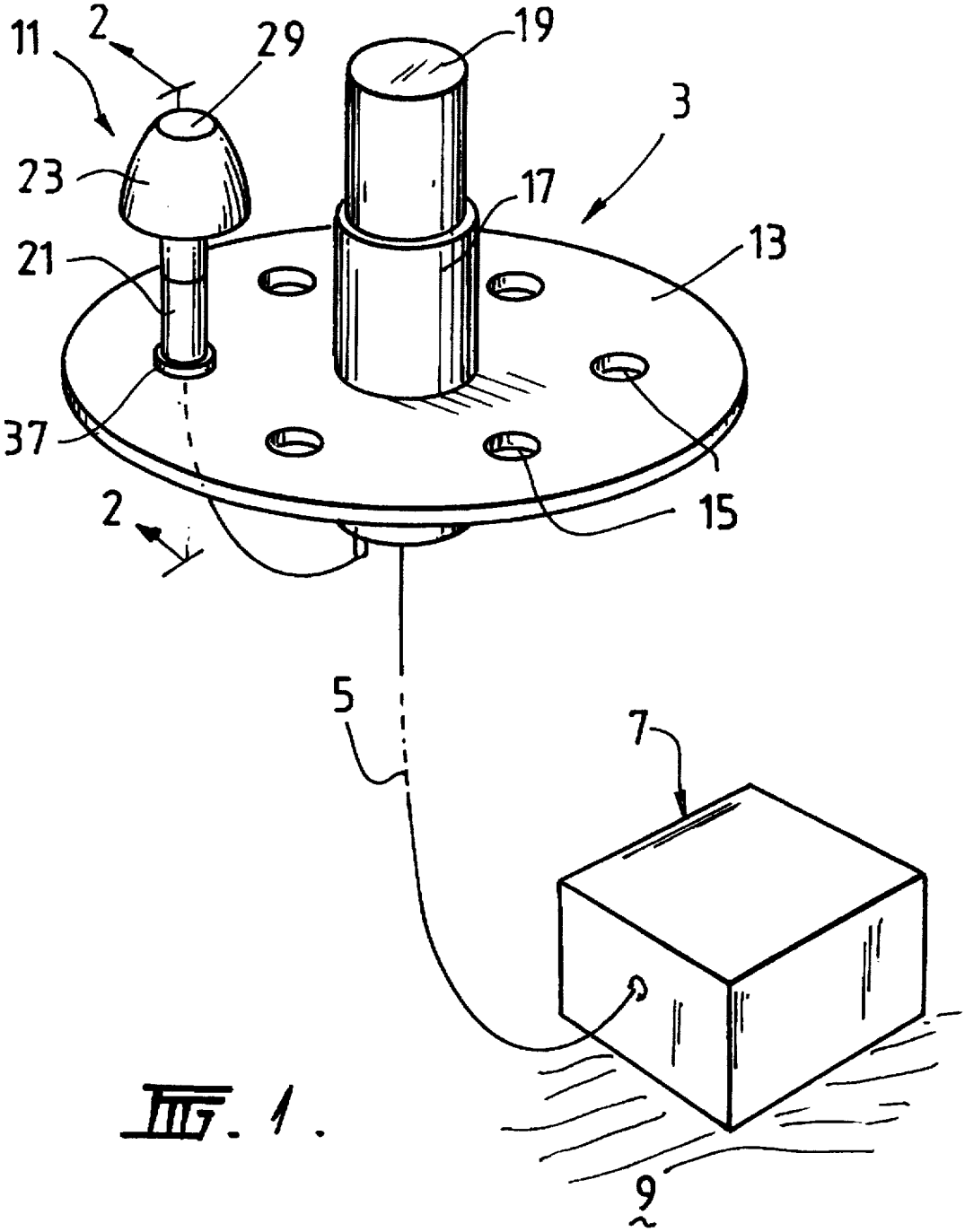
FIG. 1 is a perspective view in schematic form of the main components of a preferred embodiment of a visual indicator assembly of the present invention connected to a Stonefish Exercise Mine in an operational position underwater.

FIG. 1 illustrates in schematic form a preferred embodiment of a visual indicator assembly 3 of the present invention connected by means of a polymeric inert umbilical cord 5 to a Stonefish Exercise Mine ("SEM") 7 resting on the sea bed 9. The purpose of the visual indicator assembly 3 is to provide an almost immediate visual/audible indication on the surface that the SEM has been "fired".

The visual indicator assembly 3 comprises, six surface markers 11 (only one of which is shown in FIG. 1), and a support means in the form of a cradle 13 which supports the markers 11 underwater. The visual indicator assembly 3 further comprises a severable coupling 37 (FIGS. 2 to 4) associated with each marker 11 which, when severed, releases the markers 11 to float to the surface, and a release means which is selectively operable in response to "fired" signals from the SEM to sever the couplings 37 and to release the markers 11 in a predetermined sequence to allow the markers 11 to float to the surface.

The cradle 13 comprises a hollow PVC frame having a number of buoyant foam liners (not shown) to ensure that the visual indicator assembly 3 floats above the seabed and maintains the markers 11 in the preferred operational upright position as shown in FIG. 1. The cradle 13 further comprises a circular array of six openings 15 which, as can best be seen in FIG. 2, define the locations for the markers 11.

The cradle 13 also has a central opening which receives a cylindrical watertight container 17. A second cylindrical watertight container 19 is located on top of the container 17.

The container 17 houses a range of electronics components (not shown) including, an inbuilt hydrophone, a safe arming switch, and electronics modules which define a part of the release means for severing the couplings 37 associated with the markers 11 and thereby releasing the markers 11 to float to the surface. As is described hereinafter, the other part of the release means is associated more closely with the couplings 37.

The container 19 houses a disposable battery pack for powering the electronics components in the container 17.

Figure 2:
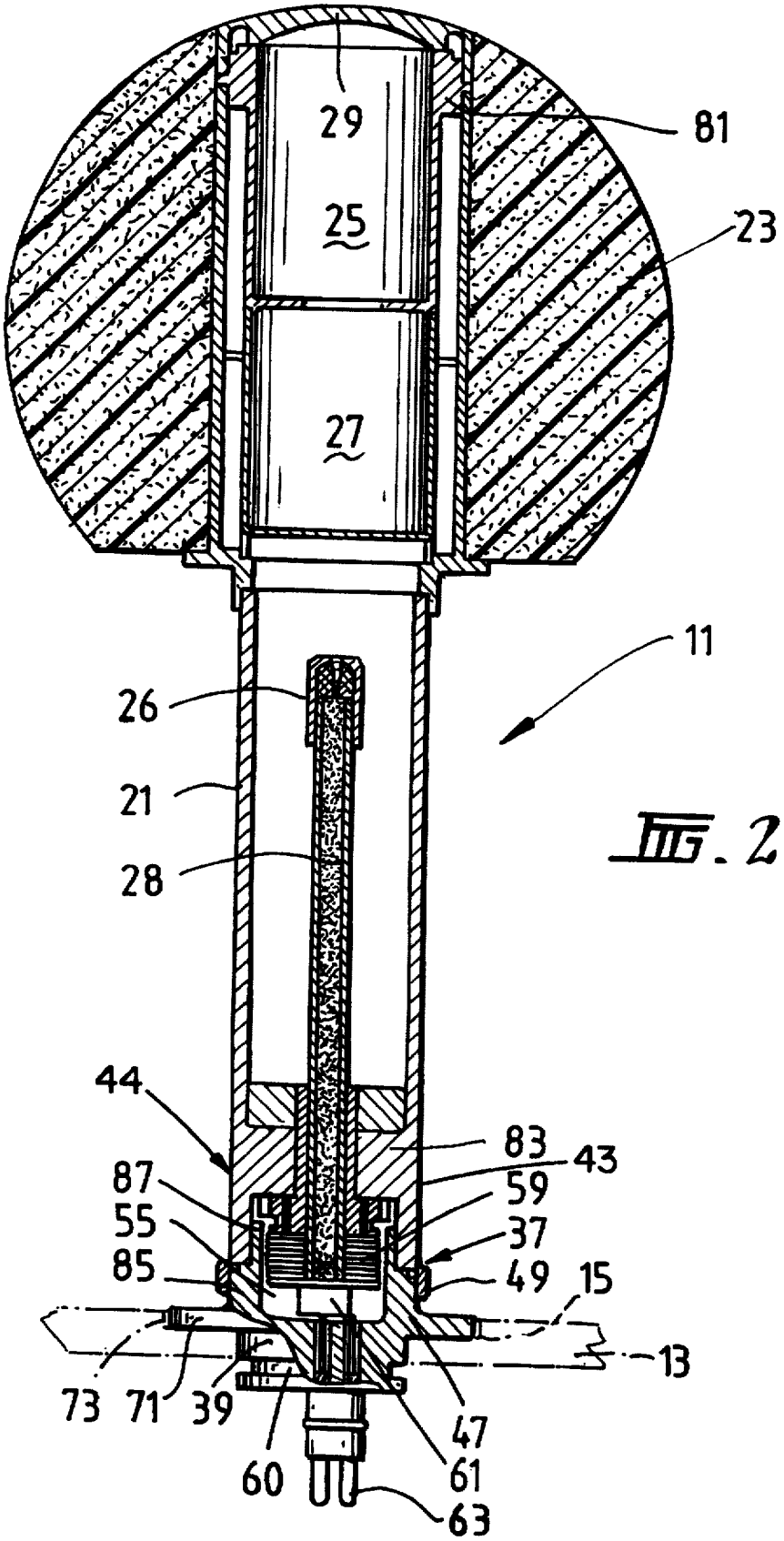
FIG. 2 is a section through the line 2—2 in FIG. 1 illustrating in detail a preferred embodiment of a marker of the visual indicator assembly.

With reference to FIG. 2, the preferred embodiment of the marker 11 shown in the figure comprises, an elongate hollow member 21 having a forward end 81 and a rear end 83, a nose closure cap 29 which closes the forward end 81, a base member 39 which extends into the rear end 83 and locates the marker 11 in one of the openings 15 in the cradle 13, and a closed cell foam collar 23 which encloses a forward section of the hollow member 21 and is shaped so that the marker 11 has a generally spherical "head". It is noted that the base member 39 of the marker 11 is retained in the cradle 13 by spring clips (not shown) or any other suitable means.

The rear end 83 of the hollow member 21 comprises a downwardly depending cylindrical skirt 44 which comprises a first part 43 and a wider diameter second part 49.

The base member 39 comprises a cylindrical sleeve 47 which extends into the rear end 83 of the hollow member 21 and engages the skirt 44. The sleeve 47 comprises a first part 85 and a narrower diameter second part 87. The diameters of the parts 43, 49 of the skirt 44 and the parts 85, 87 of the sleeve 47 are selected so that there is substantial contact between the first part 43 of the skirt 44 and the second part 87 of the sleeve 47 and between the second part 49 of the skirt 44 and the first part 85 of the sleeve 47.

The base member 39 further comprises a body member 60 which extends through the opening 15 and a flange 71 which is received in an annular recess 73 in the cradle 63.

The hollow member 21 and the foam collar 23 are designed so that on release from the cradle 13 the marker 11 floats to the surface in a stable manner at a predetermined rate, typically 3 m/sec.

The hollow member 21 houses visual and audible pyrotechnics components comprising 3 flash filled ejectable noise pods 25 and a surface burning flare 27. The hollow member 21 also houses an ignition system 26 and a time delay fuse 28 for the pyrotechnics components. The ignition system 26 and the time delay fuse 28 are designed so that the marker 11 reaches the surface before initiating an expulsion charge which creates sufficient internal pressure to shear the nose closure cap 29 and to eject the noise pods 25 upwardly into the air and to ignite the flare 27.

The noise pods 25 are designed to ignite at a maximum height, typically 4 meters, above the surface and to generate an audible noise, typically 180 db of noise at 1 meter. The flare 27 is designed to burn for a predetermined time, typically 20 seconds, and to generate sufficient gas to prevent sea water extinguishing the event and to produce an intensity that ensures visual recognition at distances of greater than 3 nautical miles under clear sunny day like conditions.

With further reference to FIG. 2, the severable coupling 37 comprises a band of reduced thickness in the rear end section 49 of the wall of the hollow member 21.

The rear end section 49 of the hollow member 21 and the base member 39 define a watertight chamber 55 which houses an expandable bellows 59 and a pyrotechnic initiator cap 61, typically 1 watt/amp no fire. The initiator cap 61 is connected by means of a connector 63 to the firing system in the container 17. The assembly of the bellows 59 and initiator cap 61 define the other part of the release means for severing the couplings 37 between the markers 11 and the cradle 13.

In use, the SEM 7 and the visual indicator assembly 3 are deployed by crane and sling from the deck of a ship onto the surface of the water and are released to sink to the seabed. As the SEM 7 and the visual indicator assembly 3 fall through the sea the umbilical cord 5 between the SEM 7 and the visual indicator assembly 3 drags the more positively buoyant visual indicator 3 well clear and to the rear of the sinking SEM 7.

As the visual indicator assembly 3 sinks to a predetermined depth, typically 10 meters, the water pressure acting on the end of the container 17 deforms the surface to initiate an internal micro-switch. The actuation of the micro-switch enables power from the battery pack in the container 19 to be applied to the electronics components in the container 17 and the visual indicator assembly 3 thereby becomes active. On the seabed the SEM 7 may become buried in mud with the visual indicator assembly 3 floating free of the surface conditions and tethered at a distance, typically 2 meters, from the SEM 7.

In order to conserve power and to enable the system to operate for prolonged periods unattended, typically 90 days, the visual indicator assembly 3 is designed with a lower power consumption mode when it is not active. In this condition the micro-controller in the container 17 enters a "sleep" mode leaving only the first stage of the sonar receiver completely awake.

When the SEM 7 detects the correct ship stimuli that induces the SEM 7 to transmit through the water a "fired" code, typically consisting of a series of 10 millisecond tone bursts, the inbuilt hydrophone in the container 17 detects the initial tone burst, and the electronics modules in the container 17 ignite the pyrotechnic initiator cap 61. The ignited pyrotechnic composition generates sufficient gas to extend the bellows 59 against the cradle 13 and thereby to apply a tensile force between the marker 11 and the cradle 13 to shear the coupling 37 and thereby to release the marker 11. The ignition of the pyrotechnic initiator cap 61 also ignites the time delay fuse 28 and thereafter the ignition system 26 for the visual and audible pyrotechnic components in the marker 11.

Figure 3:
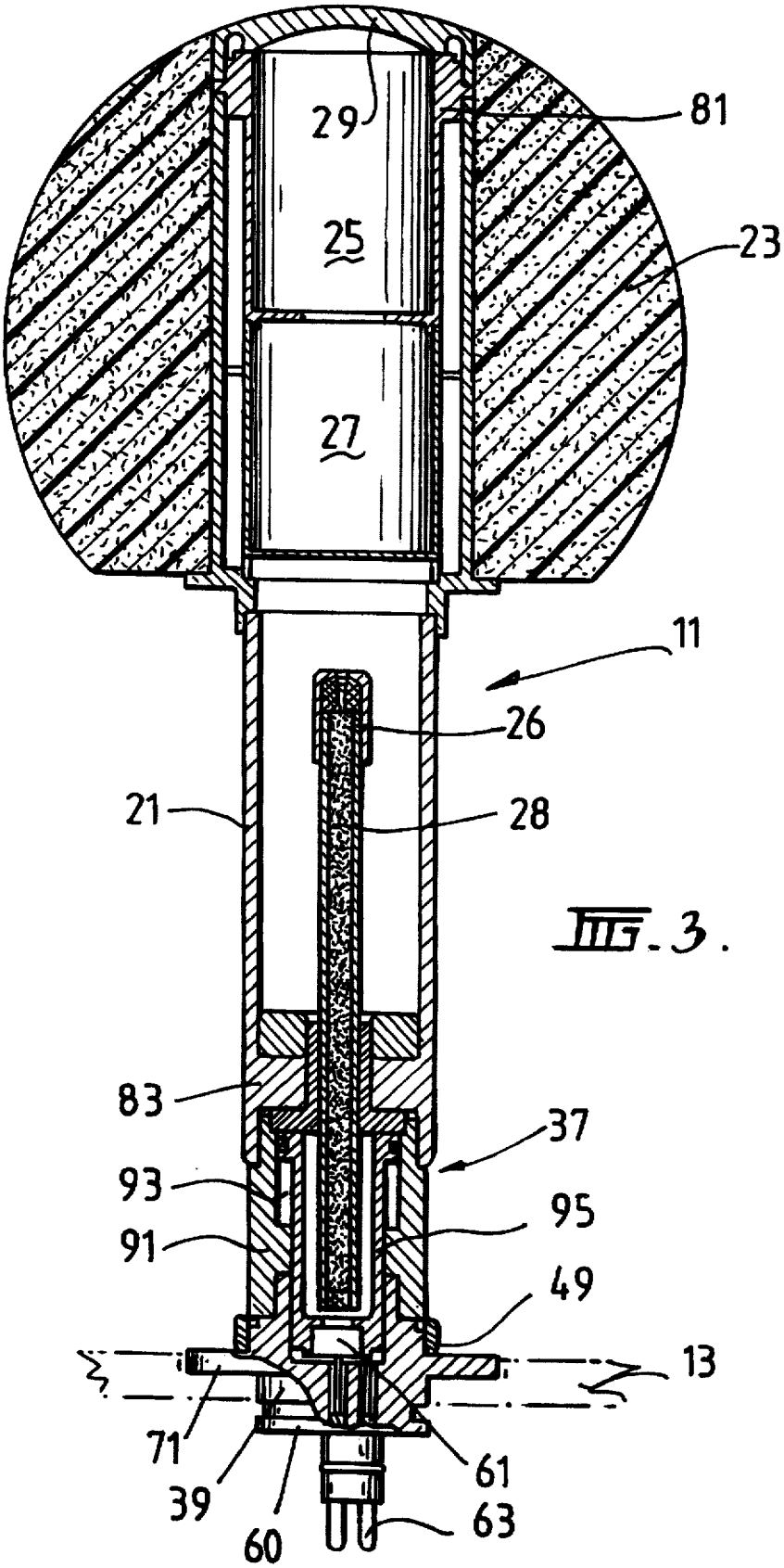
FIG. 3 is a section along the line 2—2 in FIG. 1 illustrating in detail another preferred embodiment of a marker of the visual indicator assembly.

The preferred embodiment of the marker 11 is shown in FIG. 3 is similar to that shown in FIG. 2 and the like numerals denote like parts in the figures.

The only difference between the two embodiments is that the assembly of the expandable bellows 59 in FIG. 2 is replaced by a piston assembly that is positioned between the rear end 83 of the hollow member 21 and the base member 39.

With reference to FIG. 3, the piston assembly comprises, a piston housing 91 which defines a piston chamber 93, and a piston 95 which is slidable in the piston chamber 93.

In use, when the electronics modules in the container 17 ignites the pyrotechnic initiator cap 61, the ignited pyrotechnic composition generates sufficient gas to cause the piston 95 to slide forwardly in the piston chamber 93 to apply a tensile force against the rear end 83 of the hollow member 21 to shear the coupling 37 and thereby to release the marker 11.

Figure 4:
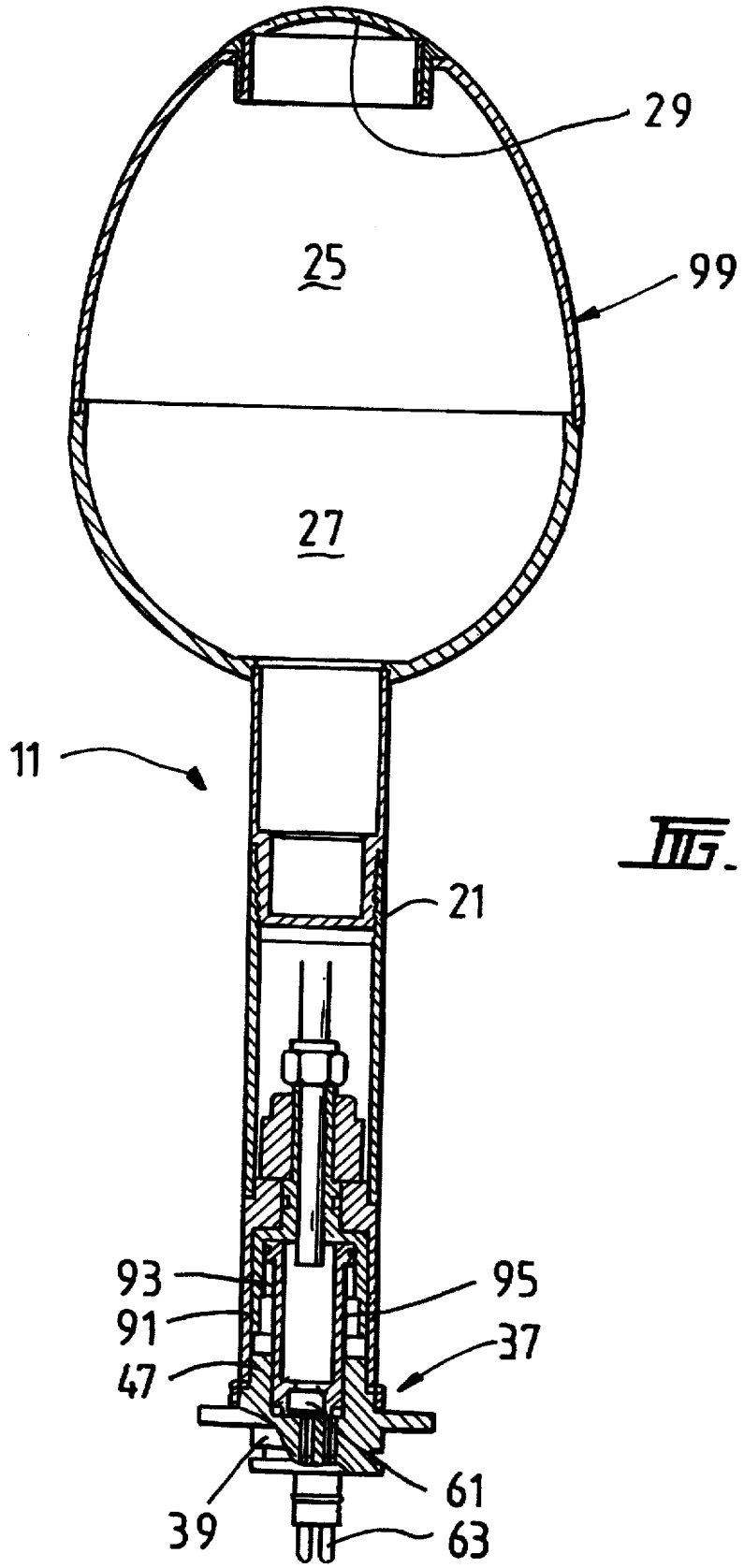
FIG. 4 is a section along the line 2—2 of FIG. 1 illustrating in detail another preferred embodiment of a marker of the visual indicator assembly.

The preferred embodiment of the marker 11 shown in FIG. 4 is similar to that shown in FIG. 3 and like numerals denote like parts in the figures.

The main difference between the two embodiments is the construction of the forward ends of the markers 11. In this connection, in the preferred embodiment shown in FIG. 4 the hollow member 11 terminates in a hollow ellipsoidal shell 99 which houses the pyrotechnic components and is capable of sinking after ignition of the pyrotechnic components. In this connection, in order to facilitate recovery, each marker 11 may house a tether (not shown) which is connected to the cradle 13 and dispensed when each marker 11 is released. The arrangement is preferable environmentally to the closed cell foam collar 23 of the preferred embodiment shown in FIG. 3.

The visual indicator assembly 3 described above with reference to the figures is a convenient and reliable means for providing an almost immediate visual and audible indication that a SEM has been detonated.

Many modifications may be made to the preferred embodiment described above without departing from the spirit and scope of the present invention.

We claim:

1. A visual indicator assembly for use in underwater applications comprising:

(a) a surface position marker comprising a forward section and a rear section, the forward section having a buoyancy means and the marker being adapted to provide visual and/or audible indications on the surface;

(b) a support means cooperating with the rear section of the marker for supporting the marker underwater;

(c) a severable coupling which couples together the forward section and the rear section of the marker; and (d) a release means comprising an ejection means for applying a tensile force between the forward section of the marker and the support means to sever the coupling and to release the forward section of the marker to float to the surface in response to a "fired" signal.

2. The assembly defined in claim 1 wherein the marker is adapted to provide visual indications when it floats to the surface.

3. The assembly defined in claim 1 wherein the marker is adapted to provide visual and audible indications when it floats to the surface.

4. The assembly defined in claim 1 wherein the marker comprises visual and/or audible pyrotechnics components.

5. The assembly defined in claim 4 wherein the marker comprises an ignition system for the visual and/or audible pyrotechnics components.

6. The assembly defined in claim 1 wherein the release means is responsive to a "fired" signal from a Stonefish Exercise Mine.

7. The assembly defined in claim 6 wherein the "fired" signal is a sonar signal.

8. The assembly defined in claim 6 wherein the release means comprises a means for receiving and recognising the "fired" signal.

9. The assembly defined in claim 1 wherein the marker houses the ejection means.

10. The assembly defined in claim 9 wherein the marker comprises a watertight compartment and that the ejection means be located in the compartment.

11. The assembly defined in claim 9 wherein the ejection means is adapted to actuate the ignition system for the visual and/or audible pyrotechnics components of the marker at the same time the ejection means applies the tensile force.

12. The assembly defined in claim 11, further comprising a delay fuse to delay ignition of the ignition system for the visual and/or audible pyrotechnics components of the marker until the marker reaches the surface.

13. The assembly defined in claim 12 comprising:

(a) a plurality of the markers; and (b) a plurality of the severable couplings.

14. The assembly defined in claim 13 wherein the release means is operable to sever the couplings and to release the markers successively in a predetermined sequence.

15. In combination, the visual indicator assembly defined in claim 1 connected to a Stonefish Exercise Mine.

* * * * *